US009924781B2

(12) United States Patent
Kalalau

(10) Patent No.: US 9,924,781 B2
(45) Date of Patent: Mar. 27, 2018

(54) HYDRATION SYSTEM ACCESSORY DEVICE

(71) Applicant: Ryan K. Kalalau, Tacoma, WA (US)

(72) Inventor: Ryan K. Kalalau, Tacoma, WA (US)

( * ) Notice: Subject to any disclaimer, the term of this patent is extended or adjusted under 35 U.S.C. 154(b) by 0 days.

(21) Appl. No.: 15/296,815

(22) Filed: Oct. 18, 2016

(65) Prior Publication Data

US 2017/0035188 A1 Feb. 9, 2017

Related U.S. Application Data

(63) Continuation-in-part of application No. 14/574,091, filed on Dec. 17, 2014, now abandoned.

(51) Int. Cl.

| | |
|---|---|
| ***B67D 7/84*** | (2010.01) |
| ***A45F 3/16*** | (2006.01) |
| ***B05B 9/08*** | (2006.01) |

(52) U.S. Cl.

CPC ..... *A45F 3/16* (2013.01); *B05B 9/085* (2013.01); *A45F 2003/166* (2013.01)

(58) Field of Classification Search

CPC ..... A54F 3/16; A54F 3/20
USPC ..... 222/175, 638, 633, 74, 209, 211–214; 224/148.2

See application file for complete search history.

(56) References Cited

U.S. PATENT DOCUMENTS

| | | | | |
|---|---|---|---|---|
| 5,282,557 | A | 2/1994 | McCook | |
| 5,571,260 | A * | 11/1996 | Krug | A45F 3/16 222/175 |
| 5,727,714 | A | 3/1998 | Fawcett | |
| 6,666,360 | B1 | 12/2003 | Swank | |
| 7,243,860 | B2 | 7/2007 | Junkel et al. | |
| 7,464,837 | B2 | 12/2008 | Hoskins | |
| 7,806,300 | B1 | 10/2010 | Noell et al. | |
| 2006/0144863 | A1 | 7/2006 | Reichert et al. | |
| 2010/0307715 | A1 * | 12/2010 | Emenheiser | A45F 3/16 165/47 |
| 2011/0132922 | A1 | 6/2011 | Summers et al. | |
| 2012/0055956 | A1 | 3/2012 | Lien | |
| 2016/0175866 | A1 | 6/2016 | Kalalau | |

FOREIGN PATENT DOCUMENTS

| | | |
|---|---|---|
| WO | WO0139620 A1 | 6/2001 |

OTHER PUBLICATIONS

Office Action for U.S. Appl. No. 14/574,091, dated Apr. 20, 2016, Kalalau, "Hydration System Accessory Device", 5 pages.

* cited by examiner

*Primary Examiner* — Lien Ngo
(74) *Attorney, Agent, or Firm* — Lee & Hayes, PLLC

(57) ABSTRACT

The systems and processes described herein correspond to a device that is to be detachably coupled to a hydration system, such as a backpack-based hydration system. The device may receive fluid from a reservoir included within the hydration system via a reservoir hose coupled to the reservoir. The device may include a pump and one or more valves that control the extent to which the fluid flows in and out of the interior of the pump. The fluid may exit a mouthpiece of the device based at least partly in response to a user applying pressure to the exterior surface of the pump, such as by the user squeezing or otherwise compressing the pump. The user may consume or otherwise use the fluid without having to apply suction to the mouthpiece of the device.

20 Claims, 6 Drawing Sheets

HYDRATION SYSTEM ACCESSORY DEVICE

RELATED APPLICATIONS

This application is a continuation-in-part of, and claims priority to, U.S. patent application Ser. No. 14/574,091, filed on Dec. 17, 2014, which is incorporated by reference herein in its entirety.

BACKGROUND

Backpack-based hydration systems allow for consumers to engage in a relatively hands free drinking experience. Typically, backpack-based hydration systems include a backpack to be worn by a user, a reservoir included within the backpack that stores liquid (e.g., water) to be consumed or otherwise used by the user, a mouthpiece utilized by the user to consume the liquid, and a hose that allows the liquid to travel from the reservoir to the mouthpiece. Backpack-based hydration systems are frequently used when a user is engaging in physical activity, such as running, hiking, snow skiing, or bicycling. In these instances, rather than having to carry a bottle that stores liquid to be consumed, the user may instead wear the backpack and consume the liquid via the mouthpiece while engaging in that physical activity.

BRIEF DESCRIPTION OF THE DRAWINGS

The detailed description is set forth with reference to the accompanying figures, in which the left-most digit of a reference number identifies the figure in which the reference number first appears. The use of the same reference numbers in the same or different figures indicates similar or identical items or features.

DETAILED DESCRIPTION

Figure 1:
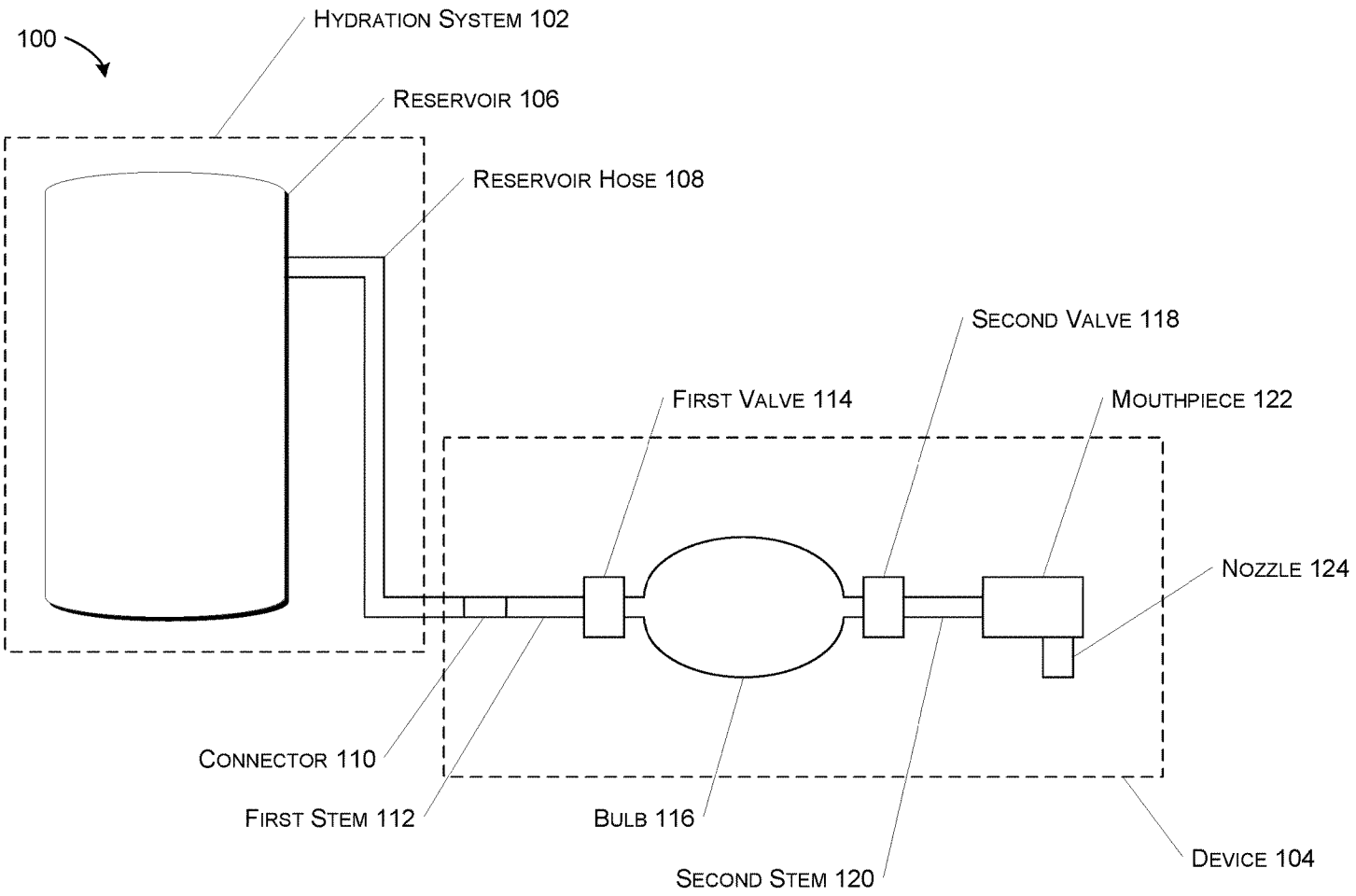
FIG. 1 illustrates a system including a hydration system and a device that is detachably coupled to the hydration system and that transports fluid to be consumed or otherwise used by a user.

Described herein are systems, devices, and techniques for delivering a fluid (e.g., a liquid or a gas) to be consumed or otherwise utilized by a user. More particularly, backpack-based hydration systems (also referred to herein as "hydration system(s)") allow a user to wear a backpack that stores fluid (e.g., water, sports drink, etc.) that is to be consumed by the user. Although many configurations are likely possible, backpack-based hydration systems typically include a carrying case (e.g., a backpack), which includes one or more straps that can be worn by the user, a reservoir within the carrying case that stores the liquid, a mouthpiece that is utilized by the user to consume the liquid, and a hose that delivers the liquid from the reservoir to the mouthpiece. To consume the liquid, the user needs to apply suction to the mouthpiece, such as by the user using his/her mouth to suck on the mouthpiece.

An advantage of backpack based-hydration systems is that a user may easily access liquids while engaging in physical activity, such as running, hiking, snow skiing, bicycling, etc. For instance, rather than having to carry a bottle and lifting the bottle to the user's mouth each time he/she would like to consume some of the liquid, the user may instead carry the liquid on his/her back via the backpack. The user may consume the liquid by keeping the mouthpiece in his/her mouth. Alternatively, the user may cause the mouthpiece to remain in close proximity to his/her mouth while engaging in physical activity, such as by using an attaching mechanism (e.g., a strap, Velcro®, etc.). When the user would like to consume the liquid, he/she may easily place the mouthpiece in his/her mouth using a single movement of the hand, without needing to identify the location of the mouthpiece. In addition, the reservoir may also have a larger capacity as compared to a bottle, thereby allowing the user to store and have access to a larger volume of liquid.

Since the user needs to apply suction to (e.g., suck on) the mouthpiece in order for the backpack-based hydration system to deliver the liquid to the user, it may be difficult to consume the liquid while engaging in physical activity. For instance, when the user is sucking on the mouthpiece in attempt to consume the liquid, the user will be unable to breathe during that time. This presents a problem when the user is engaging in strenuous physical activity, which causes the user to breathe more rapidly and/or excessively. While engaging in such physical activity, the user applying suction to the mouthpiece is likely to cause the user to lose his/her breath, which may hinder the user's ability to engage in that physical activity, and which may decrease the performance of the user as a result. Accordingly, while the user is engaging in strenuous physical activity, the user may be unable to consume a desired amount of liquid using existing backpack-based hydration systems.

In addition, existing backpack-based hydration systems do not allow a user to spray liquid (e.g., water) in areas other than the user's mouth. For instance, while the user is engaging in physical activity (e.g., running, bicycling, hiking, etc.), and/or when the temperature is relatively high or higher than normal, the user may breathe more rapidly and feel warm or hot. Ideally, the user could spray water from the backpack hydrations system onto his/her face, head, arms, etc., in an attempt to cool down. Since existing backpack-based hydration systems typically require the user to apply suction with his/her mouth in order to cause liquid to be output, such backpack-based hydration systems are limited to consuming the liquid.

Therefore, described herein is a pump adapter device that allows a user to consume a desired amount of fluid utilizing a backpack-based hydration system while engaging in physical activity. The pump adapter device may be detachably coupled to the backpack-based hydration system, and may include a bulb or pump, one or more valves, and a mouthpiece. In various embodiments, the pump adapter device may detachably couple to the hose of the backpack-based hydration system at a location where the existing mouthpiece was previously located. That is, the pump adapter device may replace the mouthpiece that typically is connected to the reservoir via the hose of the backpack-based hydration system.

In particular, the pump adapter device may include one or more valves that restrict the flow of the fluid that enters and/or exits the pump adapter device. In some embodiments, the pump adapter device may include a first valve that is disposed between the reservoir of the backpack-based hydration system and a pump or bulb of the pump adapter device. This first valve may control the extent to which the fluid stored in the reservoir of backpack-based hydration system flows into the bulb/pump of the pump adapter device. As a result, the first valve may prevent the fluid from freely flowing into the bulb/pump via the hose of the backpack-based hydration system. As the exterior of the bulb/pump of the pump adapter device is depressed or squeezed by the user, the resulting pressure within the interior of the bulb/pump may cause the first valve to allow the fluid to flow into the bulb/pump of the pump adapter device. The fluid may then be stored, possibly only temporarily, within the bulb/pump of the pump adapter device.

In other embodiments, the first valve may allow the fluid to freely flow into the interior of the bulb/pump in a single direction. As a result, the first valve may cause the interior of the bulb/pump to fill with fluid from the reservoir. When the interior of the bulb/pump is empty or is not completely filled with fluid, the first valve may allow fluid to flow into the interior of the bulb/pump, thereby causing the bulb/pump to refill with the fluid.

Alternatively, or in addition to the first valve, the pump adapter device may include a second valve that is disposed between the bulb/pump and the mouthpiece of the pump adapter device. In certain embodiments, the second valve may control the extent to which the fluid flows from the interior of the bulb/pump into the mouthpiece of the pump adapter device. Upon the user depressing or squeezing the exterior of the bulb/pump, the resulting pressure within the interior of the bulb/pump may cause the second valve to allow the fluid to exit the interior of the bulb/pump and enter the mouthpiece. As a result, the fluid may exit the pump adapter device via the mouthpiece, such as via a nozzle included within, or otherwise associated with, the mouthpiece.

In additional embodiments, the hose of the backpack-based hydration system that transports the fluid to the pump adapter device may connect to the bulb/pump at the same side as the hose that delivers the fluid to the user via the mouthpiece and/or nozzle. Each hose may connect to a bulb cap that is attached to the bulb/pump. At least one valve may be disposed within, or in proximity to, the bulb cap in order to regulate the amount of fluid that is transported within the interior of the bulb/pump and/or the amount of fluid that is transported from the interior of the bulb/pump to the user via the mouthpiece/nozzle. The at least one valve may be any type of valve, such as a check valve or some other type of valve having one or more valve balls that allow, or prevent, fluid from passing through the valve. In certain embodiments, a hose may extend from one of the valves into the interior of the bulb/pump. That way, fluid that is situated at the bottom of the bulb/pump may still be delivered to the user when the user depresses the bulb/pump, or when the user applies suction to the mouthpiece/nozzle. Accordingly, the pump adapter device may be structured such that the hoses that transport fluid into and out of the bulb/pump are located on the same side of the bulb/pump. As a result, the pump adapter device may be positioned such that the pump adapter device delivers fluid directly to the user without the user having to manipulate the position of the pump adapter device.

Accordingly, the user may attach the pump adapter device to the backpack-based hydration system. Rather than having to apply suction to the mouthpiece, the user may instead squeeze or depress the exterior of the bulb/pump of the pump adapter device, which may cause fluid to be output (e.g., sprayed, streamed, etc.) from the mouthpiece. As a result, as compared to existing backpack-based hydration systems, the user may utilize the pump adapter device in conjunction with a backpack-based hydration system to consume fluids (e.g., water) in a relatively easier manner, even while engaging in strenuous physical activity.

FIG. 1 illustrates an example system 100 for delivering a fluid to be consumed or otherwise used by a user. For the purposes of this discussion, a fluid may constitute a fluid (e.g., water, sports drink, etc.) or a gas (e.g., oxygen). As shown, the system 100 may include a hydration system 102 and a device 104. For the purposes of this discussion, the size and shape of the hydration system 102, the device 104, and/or the components thereof as illustrated in FIG. 1 may or may not be representative of their actual size and shape. In various embodiments, the device 104 may be detachably coupled to the hydration system 102, such that the device 104 may be attached to, and also removed from, the hydration system 102. However, in other embodiments, the device 104 may be permanently affixed to the hydration system 102.

The hydration system 102 may take the form of a backpack-based hydration system, which may include a reservoir 106 and a reservoir hose 108. The reservoir 106 may be any type of container (e.g., rigid, malleable, etc.) made from any type of material (e.g., plastic, metal, etc.) that is capable of storing fluid (e.g., water). A reservoir hose 108 carries or delivers the fluid from the reservoir 106 to the device 104. The reservoir hose 108 may be any type of hose or tube that is capable of transporting the fluid from the reservoir 106 to the device 104. Existing backpack-based hydration systems only include a mouthpiece at the end of the reservoir hose 108. Here, the mouthpiece at the end of the reservoir hose 108 is removed and the device 104 is inserted at the same location, or at a location in proximity to where the existing mouthpiece was previously located. In some embodiments, the mouthpiece of the existing backpack-based hydration system may then be inserted at the other end of the device 104.

As stated above, the device 104 may detachably couple to the hydration system 102, such as by a connector 110 of the device 104 attaching or coupling to the reservoir hose 108, or a connector associated with the reservoir hose 108. In some embodiments, a first end of the reservoir hose 108 may be coupled to the reservoir 106 and a second end of the reservoir hose 108 may be detachably coupled to the connector 110 of the device 104. The second end of the reservoir hose 108 may attach or couple to the connector 110 via a coupling mechanism, which may include a snapping mechanism, a screw mechanism, a clicking mechanism, and so on. That is, the connector 110 may snap onto, screw into, or click into the reservoir hose 108, or vice versa. In any event, the connector 110 of the device 104 may fasten to the second end of the reservoir hose 108 in some manner. The fluid stored in the reservoir 106 may be transported through the reservoir hose 108 into the device 104 through the connector 110.

In some embodiments, the connector 110 may not be present in the device 104, such that a first stem 112 of the device 104 is connected directly to the reservoir hose 108. For instance, the reservoir hose 108 may be inserted over a ridged inlet of the first stem 112, and friction may cause the reservoir hose 108 and the first stem 112 to remain connected. In other embodiments, the connector 110 may be integrally formed with a next component of the device 104, such as the first stem 112 or a first valve 114.

The device 104 may optionally include the first stem 112 that is coupled to the connector 110. The first stem 112 may be any type of tubing or hosing that allows the fluid to pass from the connector 110 to a first valve 114. The first stem 112 may be coupled to the connector 110 and/or the first valve 114 in any manner, such as via an adhesive (e.g., glue). In other embodiments, however, the first valve 114 may be coupled directly to the connector 110, and the first stem 112 may not be included in the device 104. Alternatively, the first stem 112 may serve as the connector 110 and may be part of the housing of the first valve 114.

The first valve 114 may be coupled to a bulb 116 of the device 104. In various embodiments, the first valve 114 may control the extent to which the fluid flows into the interior of the bulb 116. For the purposes of this discussion, a valve may correspond to a device that regulates, directs, or controls the flow of the fluid by opening, closing, or partially obstructing a passageway. In general, when the first valve 114 is closed, the fluid may not pass through the first valve 114 into the interior of the bulb 116. However, if the first valve 114 is considered to be open, the fluid may flow in a direction from higher pressure to lower pressure. That is, if the pressure within the interior of the bulb 116 is less than the pressure on the other side of the first valve 114, the fluid is likely to flow through the first valve 114 into the interior of the bulb 116. As discussed in additional detail below, the first valve 114 may be a check valve, which may restrict the fluid to moving only in a single direction through the first valve 114.

In other embodiments, the first valve 114 may allow the fluid to flow into the interior of the bulb 116 in a single direction, thereby allowing the bulb 116 to be filled and/or refilled with the fluid. That is, the fluid may passively flow from the reservoir 106 to the interior of the bulb 116, while the first valve 114 may prevent the fluid from flowing in the opposite direction out of the interior of the bulb 116. As a result, when the bulb 116 is empty, or when some of the fluid flows out of the bulb 116, the first valve 114 may allow the bulb to fill with the fluid. However, in other instances, the first valve 114 may allow the fluid to flow in multiple directions, such that the fluid may flow into and out of the interior of the bulb 116 via the first valve 114.

In certain embodiments, the first valve 114 may be connected or coupled to a first end of the bulb 116 and a second valve 118 may be connected or coupled to a second end of the bulb 116. The bulb 116 may include any type of bulb, pump, or compressible object that the user may squeeze or depress (e.g., apply pressure to the exterior surface of the bulb 116) for the purpose of causing the fluid to be output from the device 104. For instance, the bulb 116 may be a pump having a trigger or lever mechanism that, when actuated by a user, causes the fluid to be output from the device 104. Such a pump may also have a spring mechanism that draws the next dose of fluid into the pump/bulb 116. The bulb 116 may include any other component or mechanism that causes fluid to be output from the device 104, such as via the second valve 118 of the device 104. Both the first end and the second end of the bulb 116 may have corresponding openings (e.g., a first opening and a second opening) that allow the fluid to pass into and out of the interior of the bulb 116. The bulb 116 may be of any size and may be made of any material (e.g., rubber, plastic, etc.) that allows the bulb 116 to be compressed by the user, such as by the hand of the user. After being compressed by the user, and when the user decreases the pressure being applied to the exterior of the bulb 116, the bulb 116 may then return to its original state.

As stated above, the second end of the bulb 116 may be connected or coupled to the second valve 118, which may be the same as, or different from, the first valve 114. The second valve 118 may control the extent to which the fluid flows from the interior of the bulb 116 through the second valve 118 to a second stem 120 of the device 104. Similar to the first stem 112, inclusion of the second stem 120 in the device 104 is optional, and the second valve 118 may instead be coupled directly to a mouthpiece 122 of the device 104. Inclusion of the first stem 112 and/or the second stem 120 in the device 104 may cause the device 104 to be extended or elongated, while exclusion of the first stem 112 and/or the second stem 120 may cause the device 104 to be shorter or more compact. Provided that the first stem 112 and/or the second stem 120 is included in the device 104, the size and/or length of the device 104 may vary based on the length and overall size of the first stem 112 and/or the second stem 120.

In various embodiments, the second valve 118 may be connected or coupled to the mouthpiece 122 via the second stem 120, or the second valve 118 may be directly connected or coupled to the mouthpiece 122. The second valve 118 may control the extent to which the fluid flows from the interior of the bulb 116 through the second valve 118 into the mouthpiece 122. Provided that does occur, the fluid may exit the mouthpiece 122 via a nozzle 124. The mouthpiece 122 may correspond to the portion of the device 104 that comes near or in contact with the user's mouth during use. That is, the user may place the mouthpiece 122 inside of, in front of, or in close proximity to his/her mouth for the purpose of consuming the fluid that exits the mouthpiece 122. In certain embodiments, a stream or spray of the fluid may exit the mouthpiece 122. For instance, in addition to causing the fluid to spray into his/her mouth, the user may position the mouthpiece 122 such that the fluid sprays onto other parts of the user's body, such as his/her face, head, hair, arms, back, chest, and so on. The user may do so to cool down while engaging in physical activity.

In various embodiments, the mouthpiece 122 may optionally include, be associated with, or be in fluid communication with the nozzle 124. For the purposes of this discussion, the mouthpiece 122 being in fluid communication with the nozzle 124 may indicate that the fluid flows from the mouthpiece 122 to the nozzle 124, which then outputs the fluid. That is, the mouthpiece 122 may temporarily store the fluid after the fluid has exited the interior of the bulb 116 via the second valve 118 and possibly the second stem 120.

The nozzle 124 may correspond to a device or portion or mouthpiece 122 that is designed to control the direction or characteristics of the flow (e.g., increase the velocity of the flow) of the fluid that is exiting the device 104. In some embodiments, the nozzle 124 may include a pipe or tube of varying cross sectional area, which is used to direct or modify the flow of the fluid as it exits the device 104. Moreover, the nozzle 124 may control the rate of flow, speed, direction, mass, shape, and/or pressure of the stream of fluid that exits the mouthpiece 122. The nozzle 124 may be manually adjusted by the user, or may adjust automatically, to modify the flow of the fluid exiting the device 104. As a result, the user may customize the device 104 by modifying the nozzle 124 to determine a preferred rate, pressure, and/or direction in which the fluid exits the device 104. For instance, the user may adjust the nozzle 124 based on the amount of fluid that the user would like to consume. In various embodiments, if the nozzle 124 was not included in the device 104, the fluid may flow out of an opening in the mouthpiece 122.

The extent to which the fluid exits the device 104 may be dependent upon actions taken by the user operating and/or wearing the hydration system 102 and the device 104. In particular, the user may control the extent to which the fluid exits the mouthpiece 122 by applying pressure to the exterior surface of the bulb 116, such as by squeezing, depressing, or compressing the bulb 116 of the device 104. If there is no, or little, fluid included in the bulb 116, compression of the bulb 116 may cause fluid to pass through the first valve 114 into the interior of the bulb 116. The fluid may also freely flow into the interior of the bulb 116 via the first valve 114. However, compression of the bulb 116 when fluid is currently present in the bulb 116 may cause that fluid to pass through the second valve 118 and then out of the mouthpiece 122 and/or nozzle 124. The resulting pressure within the interior of the bulb 116 may also cause additional fluid to pass through the first valve 114 into the interior of the bulb 116, which would replace the fluid that previously exited the device 104 via the nozzle 124. As stated above, when the fluid within the interior of the bulb 116 exits through the second valve 118, the first valve 114 may allow the fluid to passively flow into the interior of the bulb 116, thereby causing the bulb 116 to refill with the fluid. As a result, the different components of the device 104 may contain fluid while the device 104 is in use, and even when the device 104 is not currently being used.

Therefore, by squeezing, or otherwise applying pressure to the exterior surface of, the bulb 116 of the device 104 while the device 104 is coupled to the hydration system 102, the user may cause the fluid stored in the reservoir 106 of the hydration system 102 to exit the device 104, without having to apply suction to a mouthpiece of the hydration system 102 and/or the device 104. Provided that the user places the mouthpiece 122 of the device 104 in, or in close proximity to, his/her mouth, the user may consume the fluid as a result of squeezing the bulb 116, thereby avoiding or significantly decreasing breathing difficulties while using the hydration system 102 during physical activity. In addition, the mouthpiece 122 may be placed in a position such that the fluid is sprayed on other parts of the user's body, such as the user's face, head, hair, arms, chest, back, and so on. By spraying the fluid on himself/herself, the user may cool down while engaging in physical, and possibly strenuous, activity.

Figure 2:
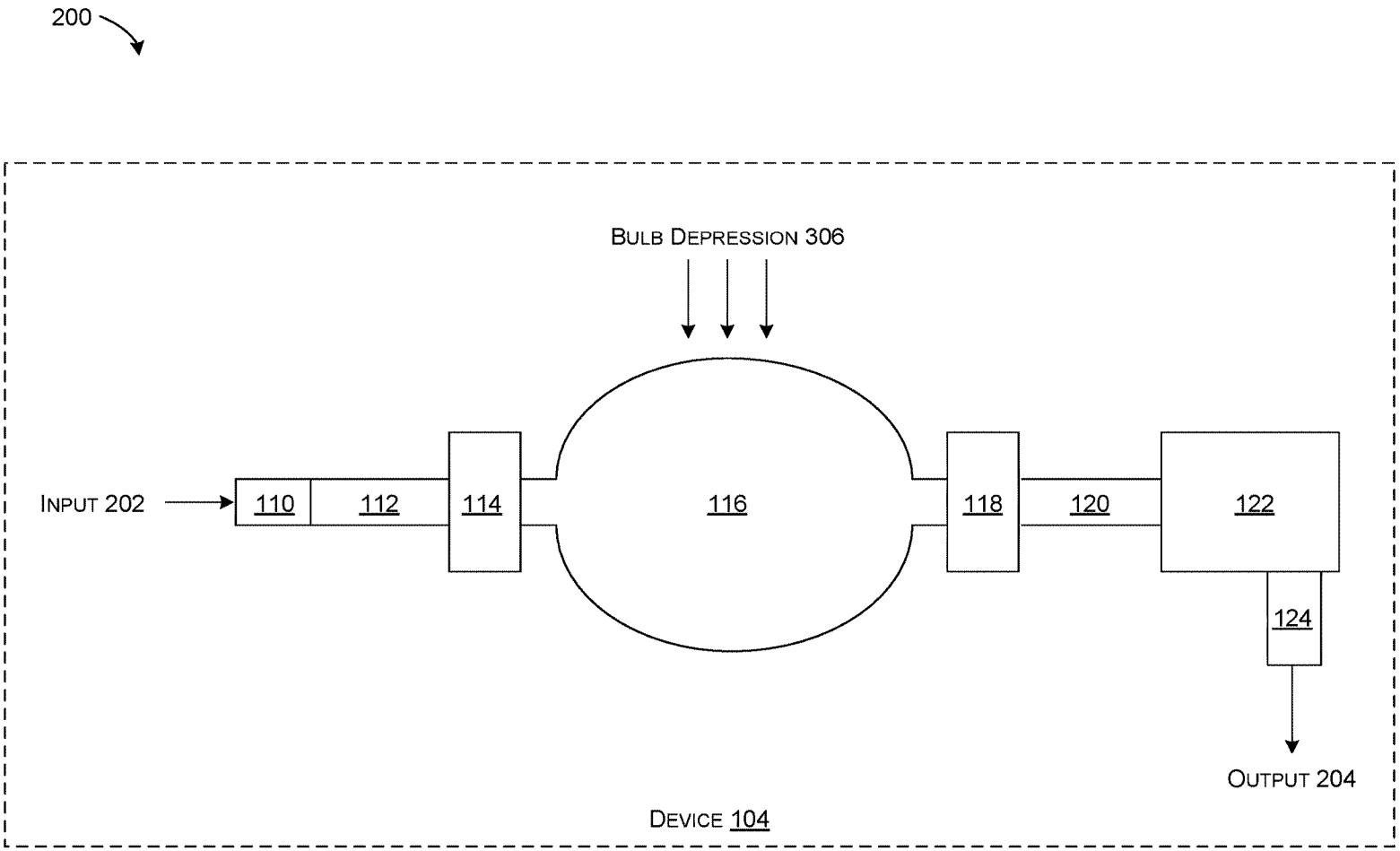
FIG. 2 illustrates a diagram showing the device depicted in FIG. 1, where the device delivers the fluid to a user based at least partly on the user depressing a bulb of the device.

FIG. 2 illustrates an example diagram 200 of the device 104, as described above with respect to FIG. 1. As shown, the device 104 may include the connector 110, the first stem 112, the first valve 114, the bulb 116, the second valve 118, the second stem 120, the mouthpiece 122, and the nozzle 124. However, the device 104 may include some or all of the components listed above. For instance, the first stem 112 and/or the second stem 120 may not be included in the device 104. In addition, the device 104 may include one or both of the first valve 114 and the second valve 118.

Although not shown in FIG. 2, the device 104, and the connector 110 in particular, may be connected or coupled to the reservoir hose 108 of the hydration system 102, or to a connector associated with the reservoir hose 108. The connector 110 may also be part of the first stem 112 or the first valve 114. As a result, the device 104 may receive input 202, which may correspond to the fluid that is stored in the reservoir 106 of the hydration system 102. The fluid may flow through the connector 110 and, optionally, through the first stem 112 to the first valve 114. In various embodiments, the first valve 114 may control the extent to which the fluid flows into the interior of the bulb 116 of the device 104. Moreover, the second valve 118 may control the extent to which fluid currently residing in the interior of the bulb 116 flows through the second valve 118 into the mouthpiece 122. As shown, the second valve 118 and the mouthpiece 122 may be connected via the second stem 120, or the second valve 118 and the mouthpiece 122 may be connected directly to one another. Upon the second valve 118 allowing the fluid to pass through, the fluid may flow into the mouthpiece 122 and exit out the nozzle 124 as output 204. That is, the fluid may flow out of the nozzle 124 and be consumed or otherwise used (e.g., sprayed on the body of the user) by the user operating the device 104 in conjunction with the hydration system 102.

In various embodiments, the fluid may exit the device 104 as a result of a bulb depression 306 performed by a user operating the device 104. That is, in response to the user applying pressure to the exterior surface of the bulb 116, such as by squeezing, depressing, or compressing the bulb 116, the device 104 may output the fluid via the mouthpiece 122 and/or the nozzle 124. More particularly, the user manually squeezing the bulb 116 may cause the second valve 118 to allow the fluid to flow from the interior of the bulb 116 to the mouthpiece 122, which results in the output 204. The bulb depression 306 may also cause the first valve 114 to allow the fluid to flow into the interior of the bulb 116. As discussed in additional detail below, provided that the first valve 114 and the second valve 118 are each check valves, the fluid flows in a direction from the connector 110 to the mouthpiece 122. In other words, the check valves cause the fluid to flow in a single direction, as opposed to the fluid flowing multiple directions through the first valve 114 and the second valve 118.

Figure 3:
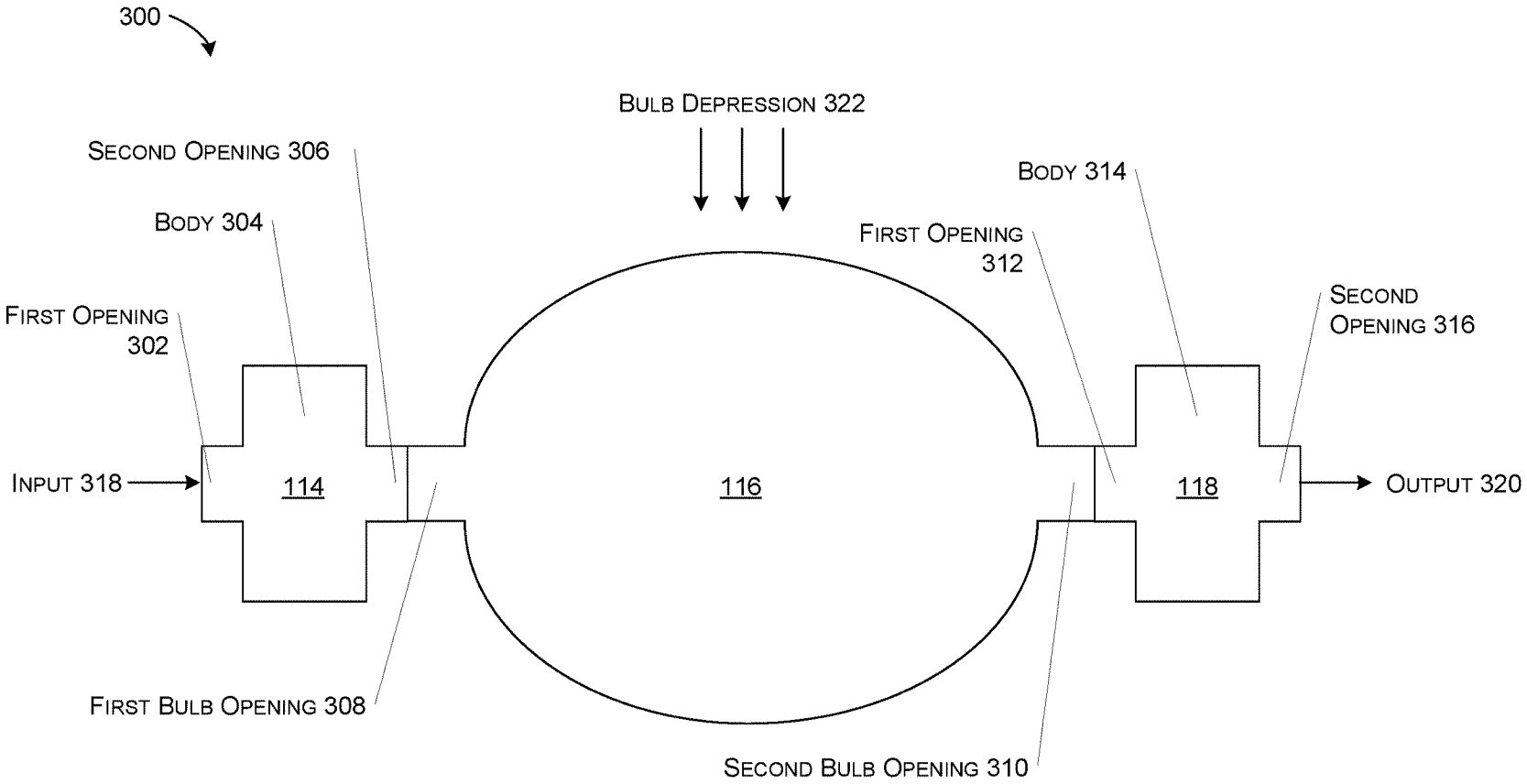
FIG. 3 illustrates a diagram showing a portion of the device depicted in FIGS. 1 and 2, where the device includes two valves and a bulb that controls the extent to which the fluid is delivered to a user.

FIG. 3 illustrates an example diagram 300 of a portion of the device 104, as described above with respect to FIGS. 1 and 2. In particular, FIG. 3 illustrates the first valve 114, the bulb 116, and the second valve 118 of the device 104. Although not shown, the device 104 may also include the connector 110, the first stem 112, the second stem 120, the mouthpiece 122, and/or the nozzle 124.

In various embodiments, the first valve 114 and/or the second valve 118 may each be a check valve, which also may be referred to as a clack valve, a non-return valve, or a one-way valve. For the purposes of this discussion, a check valve may correspond to a valve that typically allows a fluid to flow through the check valve only in a single direction, meaning that the first valve 114 and/or the second valve 118 may allow the fluid to flow in a first direction, but may not allow the fluid to flow in a second, different or opposite direction (e.g., backflow). Moreover, a check valve may be considered a two-port valve, meaning that a check valve has at least two openings in the body of the check valve. A first opening may allow fluid to enter the check valve, while a second opening may allow the fluid to exit the check valve. Moreover, the check valve may be designed for and specified for a particular pressure, which may be referred to as a cracking pressure. The cracking pressure may correspond to a minimum amount of upstream pressure (e.g., upstream with respect to the flow of the fluid) at which the check valve can operate. That is, the check valve may allow fluid to pass from an area of higher pressure (a first side of the check valve) to an area of lower pressure (a second side of the check valve). The first valve 114 and the second valve 118 may be one of many different types of check valves, including a ball check valve, a diaphragm check valve, a swing check valve (also referred to as a tilting disc check valve), a stop-check valve, a lift-check valve, an in-line check valve, a duckbill valve, a double check valve, a wafer check valve, a ball-and-cone check valve, a piston check valve, and/or a pneumatic non-return valve.

Therefore, the first valve 114 and the second valve 118 may prevent the fluid from flowing freely from the reservoir hose 108 of the hydration system 102 to the mouthpiece 122 of the device 104. As shown in FIG. 3, the first valve 114 may include a first opening 302, a body 304, and a second opening 306. The body 304 of the first valve 114 may include a mechanism or one or more components that control the extent to which the fluid flows into the first valve 114 via the first opening 302 and out of the first valve 114 via the second opening 306. Moreover, the bulb 116 of the device 104 may include a first bulb opening 308 in which fluid enters the interior of the bulb 116 and a second bulb opening 310 in which the fluid exits the interior of the bulb 116 into the second valve 118. The fluid that exits the bulb 116 via the second bulb opening 310 may enter the second valve 118 via a first opening 312. Similar to the first valve 114, one or more mechanisms or components within a body 314 of the second valve 118 may control the extent to which the fluid exits the second valve 118 via a second opening 316. The fluid exiting the second valve 118 may be referred to as output 320.

While using the device 104 in conjunction with the hydration system 102, the user may perform a bulb depression 322, which may constitute the user applying pressure to the exterior surface of the bulb 116, such as by squeezing, depressing, or compressing the bulb 116. As a result of the bulb depression 322, the pressure within the body of the bulb 116 (i.e., the interior of the bulb 116) may increase. If the pressure within the interior of the bulb 116 is greater than the pressure on the opposite side of the second valve 118, the second valve 118 may cause the fluid within the interior of the bulb 116 to pass through the second valve 118 and flow out of the second opening 316 of the second valve 118 as the output 320. That is, the second valve 118 may open, allowing the fluid to pass through the second valve 118. Once the pressure within the bulb 116 is approximately equal to the pressure on the opposite side of the second valve 118, the second valve 118 may prevent additional fluid from passing through. As a result, when the user squeezes the bulb 116 of the device 104, fluid within the bulb 116 may flow out of the device 104, thereby allowing the user to consume or otherwise use the outputted fluid. When the user releases the bulb 116, the second valve 118 may close, thereby preventing additional fluid from exiting the interior of the bulb 116 via the second valve 118.

In addition, prior to the bulb depression 322, the pressure within the bulb 116 may be less than the pressure on the opposite side of the first valve 114. Provided this occurs, the first valve 114 may allow the fluid to flow from the first opening 302 of the first valve 114 through the second opening 306 of the first valve 114, causing the interior of the bulb 116 to at least partially fill with the fluid. Then, after the bulb depression 322 causes the second valve 118 to allow the fluid within the bulb 116 to exit through the second opening 316 of the second valve 118, the pressure within the interior of the bulb 116 may return to a level that is approximately the same as the pressure prior to the bulb depression 322. As a result, the first valve 114 may allow the fluid to flow into the bulb 116, thus replacing the fluid that previously exited the device 104. That is, the extent to which fluid enters and exits the interior of the bulb 116 may depend upon the pressure within the interior of the bulb 116, which may be generated and may vary based on the amount of pressure being applied to the exterior surface of the bulb 116 (e.g., how hard the user is squeezing the bulb 116).

Accordingly, the presence of check valves within the device 104 prevents the fluid from freely flowing into and out of the device, and allows for at least some fluid to remain within the bulb 116 of the device 104. This allows the user to consume the fluid at his/her disposal by merely squeezing the bulb 116 of the device 104, as opposed to needing to suck on the mouthpiece 122 of the device 104.

However, in other embodiments, the first valve 114 may allow the fluid to pass freely into the interior of the bulb 116, depending upon the amount of fluid currently within the bulb 116. Accordingly, when the interior of the bulb 116 is not full with fluid, the first valve 114 may allow the interior of the bulb 116 to fill or refill with the fluid. As stated above, the first valve 114 may only allow the fluid to flow in a single direction from the reservoir 106 into the bulb 116. Alternatively, the first valve 114 may allow the fluid to flow freely into and out of the bulb 116.

Figure 4:
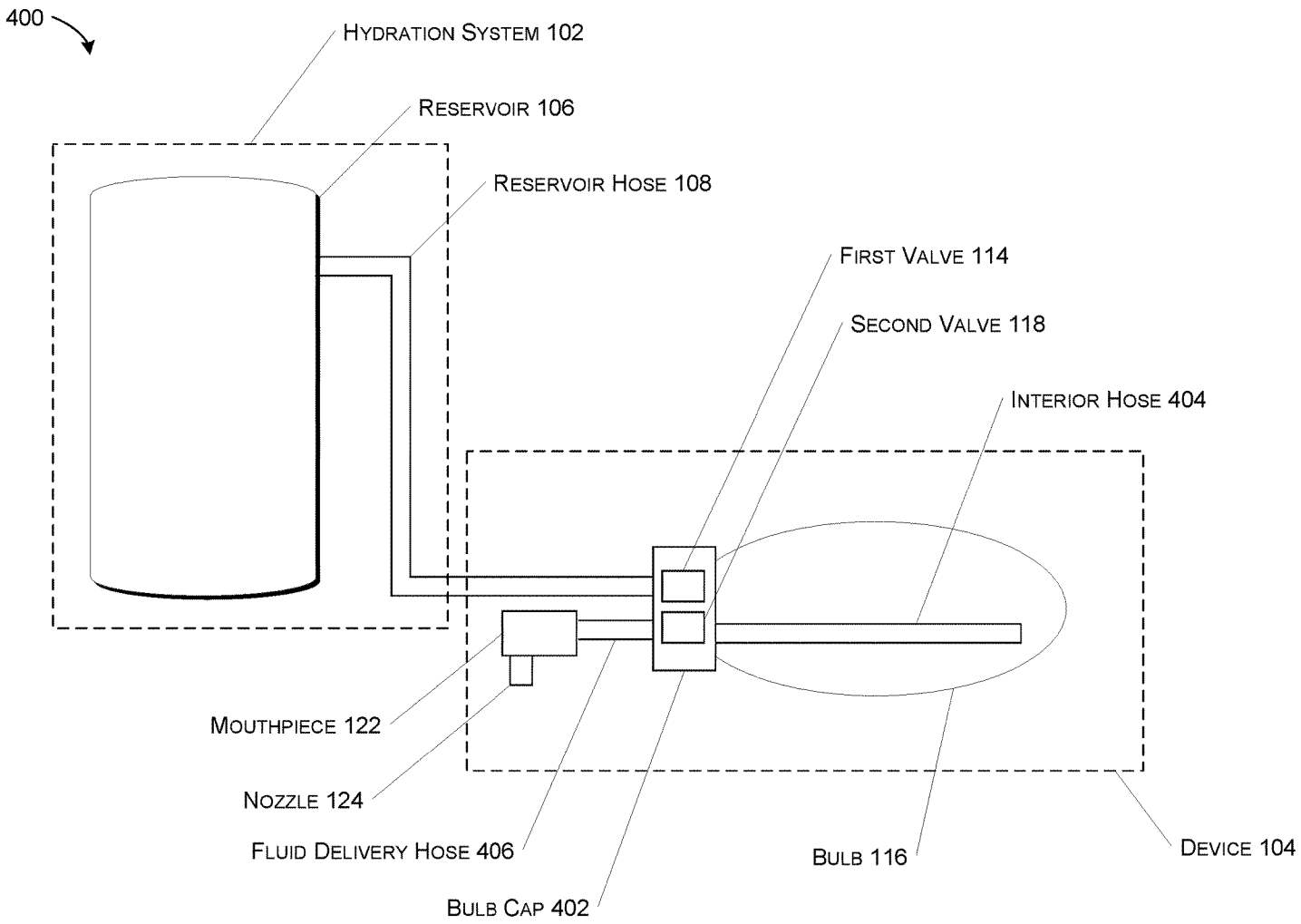
FIG. 4 illustrates a system including a hydration system and a device that is detachably coupled to the hydration system and that transports fluid to be consumed or otherwise used by a user.

FIG. 4 illustrates an example system 400 for delivering a fluid to be consumed or otherwise used by a user. For the purposes of this discussion, the hydration system 102, the reservoir 106, and the reservoir hose 108 may be similar to those illustrated in, and described with respect to, FIGS. 1-3. However, the device 104 may be different in some respect with respect to the device 104 illustrated in, and described with respect to, FIGS. 1-3. As shown, the hydration system 102 may transport fluid (e.g., water, a sports drink, etc.) to the device 104 from the reservoir 106 via the reservoir hose 108. The reservoir hose 108 may be permanently or detachably coupled to the device 104 via a bulb cap 402 of the device 104. The bulb cap 402 may be made of any material (e.g., plastic, metal, etc.) or shape (e.g., cylindrical, a cube, rectangular, spherical, etc.) and may be permanently or detachably coupled to the bulb 116.

Although any configuration is contemplated, the bulb cap 402 may include or house the first valve 114 and the second valve 118. As a result, fluid may be transported via the reservoir house 108 into a first side of the bulb cap 402 and through the first valve 114, such that the fluid is delivered to the interior of the bulb 116 via a second side of the bulb cap 402. As shown, the device 104 also includes an interior hose 404 that is located/positioned within the interior of the bulb 116. The interior hose 404 may extend from the second side of the bulb cap 402 down to the opposite end of the bulb 116. The interior hose 404 may be connected to the second side of the bulb cap 402 and/or the second valve 118, which is also located within the bulb cap 402. Also attached (either permanently or detachably) to the first side of the bulb cap 402 is a fluid delivery hose 406 that is connected to the mouthpiece 122 and the nozzle 124.

Provided that there is fluid within the interior of the bulb 116, a user may depress or squeeze the bulb 116, such as by the user holding the bulb 116 in his/her hand and squeezing the bulb 116 using his/her fingers to exert pressure/force on one or more exterior surfaces of the bulb 116. Upon the bulb 116 being depressed/squeezed, the fluid within the interior of the bulb 116 may be delivered into the user's mouth, or onto the user's face, hair, etc. More particularly, the fluid within the interior of the bulb 116 may be directed into the interior hose 404, transported through the second valve 118, transported through the fluid delivery hose 406, and transported out of the mouthpiece 122/nozzle 124 of the device 104.

In certain embodiments, the interior hose 404 may be permanently or detachably coupled to the second side of the bulb cap 402 that is located proximate to the interior of the bulb 116. Moreover, the interior hose 404 may be made of any material (e.g., plastic, metal, etc.), and may be coupled to the second valve 118 via a stem. Additional stems may also be included, such as a stem that couples the reservoir hose 108 to the bulb cap 402 or first valve 114, a second stem that is positioned between the first valve 114 or the bulb cap 402 and the interior of the bulb 116, a third stem that couples the interior hose 404 to the bulb cap 402 or the second valve 118, and/or a fourth stem that couples the fluid delivery hose 406 to the bulb cap 402 or the second valve 118. Moreover, the fluid delivery hose 406 may be any mechanism that transports the fluid to the user via the mouthpiece 122 and/or the nozzle 124, such as plastic/metal tubing. Moreover, the fluid delivery hose 406 may be of any length, or may be absent if the mouthpiece 122/nozzle 124 is connected directly to the first side of the bulb cap 402 or a stem coupled to the first side of the bulb cap 402.

Figure 5:
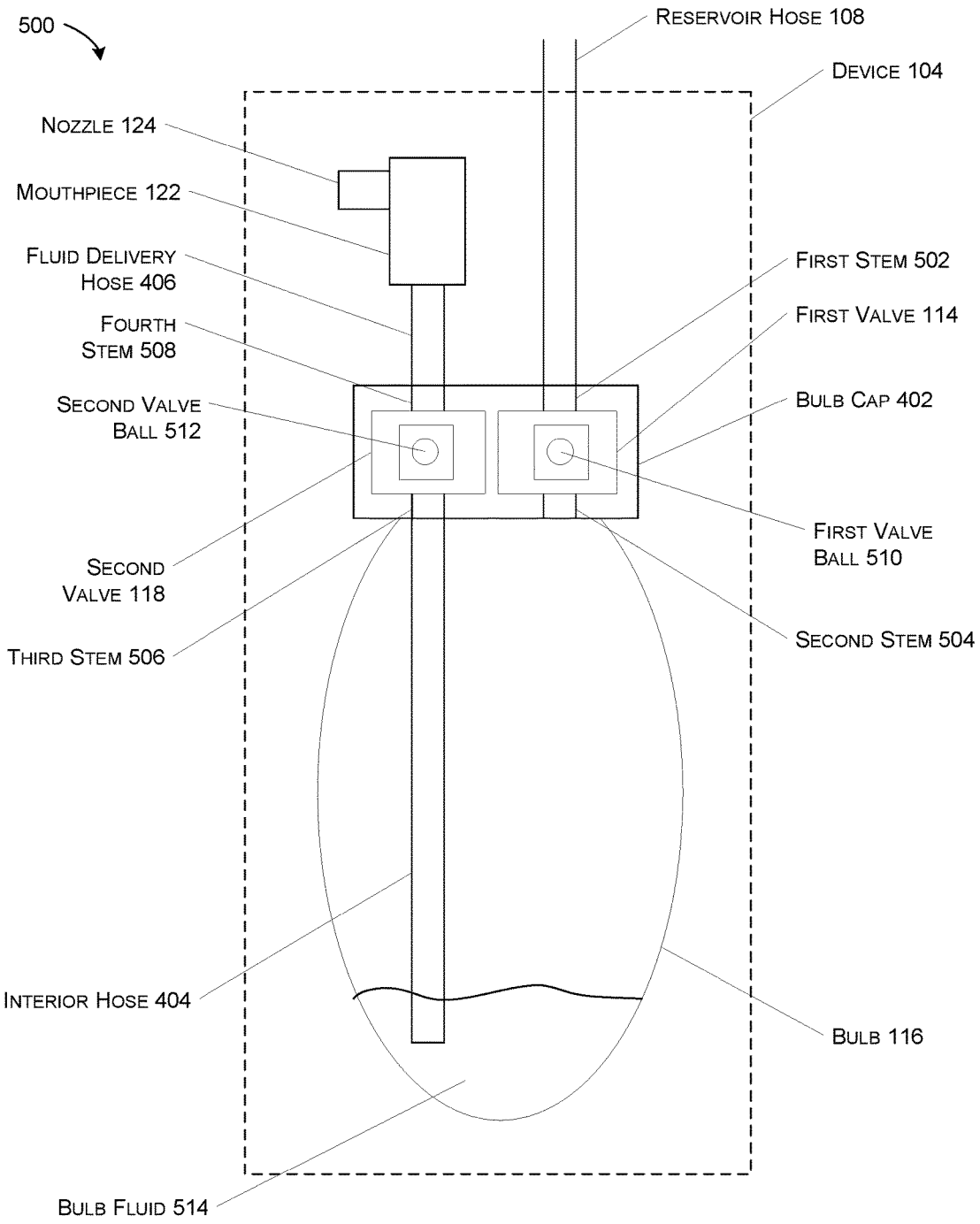
FIG. 5 illustrates a diagram showing the device depicted in FIG. 4, where the device delivers the fluid to a user based at least partly on the user depressing a bulb of the device.

FIG. 5 illustrates an example diagram 500 of the device 104, as described above with respect to FIG. 4. As shown, the reservoir hose 108 that transports fluid from the reservoir 106 of the hydration system 102 to the device 104 is coupled to a first side of the bulb cap 402 of the device 104. The fluid delivery hose 406 that delivers the fluid to the user via the mouthpiece 122/nozzle 124 is also coupled to the first side of the bulb cap 402 of the device 104. In various embodiments, the bulb cap 402 serves to house the first valve 114 and/or the second valve 118, and to prevent fluid within the interior of the bulb 116 from exiting out of the bulb 116. For instance, the bulb 116 may have a single opening, and the bulb cap 402 may be coupled/attached to that opening. Moreover, the bulb cap 402 may have two openings, such as a first opening in which fluid is transported into the bulb 116 (via the reservoir hose 108) and a second opening in which the fluid exits the bulb 116 (via the fluid delivery hose 406.

As referenced above with respect to FIG. 4, the device 104 may (or may not) include one or more stems. For instance, the reservoir hose 108 may be coupled to the first side of the bulb cap 402 and/or the first valve 114 via a first stem 502. Moreover, the fluid that is transported via the reservoir house 108 and that passes through the first valve 114 may enter the interior of the bulb 116 via a second stem 504 that is coupled to the second side of the bulb cap 402 and/or the first valve 114. In additional embodiments, the interior hose 404 that is located within the interior of the bulb 116 may be coupled to the second side of the bulb cap 402 and/or the second valve 118 via a third stem 506. Moreover, the fluid delivery hose 406 that transports the fluid to the user may be coupled to the first side of the bulb cap 402 and/or the second valve 118 via a fourth stem 508. For the purposes of this discussion, some, all, or none of the stems described above may be included on or within the device 104.

As stated above, the device 104 may include any number of valves that allow fluid to be transported (or not) into the interior of the bulb 116 and/or that allow fluid to be transported (or not) from the interior of the bulb 116 to the user via the fluid delivery hose 406. However, as illustrated in FIG. 5, the device 104 may include two valves—a first valve 114 and a second valve 118. The first valve 114 and the second valve 118 may be any type of valve, such as a check valve. For instance, the first valve 114 and/or the second valve 118 may include one or more balls that may allow or prevent fluid from passing through the valves. As shown, although any number of valve balls may be included within, or otherwise associated with, the valves, the first valve 114 may include a first valve ball 510 and the second valve 118 may include a second valve ball 512. The first valve ball 510 and the second valve ball 512 may be of any size or shape, and may be made of any material (e.g., plastic, metal, stone, etc.). The first valve ball 510 and the second valve ball 512 may be of a size and/or shape that prevent fluid from freely passing through the first valve 114 and the second valve, respectively. The interior of the bulb cap 402 may also include other physical components that maintain the position of the first valve ball 508 and the second valve ball 512.

In certain embodiments, a user may physically hold the device 104 such that the first side of the bulb cap 402 is facing upwards. That is, the side of the bulb cap 402 that is coupled to the reservoir hose 108 and the fluid delivery hose 406 is facing up. In this embodiment, the second side of the bulb cap 402 and the bulb 116 itself will be facing downwards. As a result, in this orientation, any fluid that is included within the interior of the bulb 116 will collect at the bottom of the bulb 116, which may be represented by bulb fluid 514. Provided that the device 104 is being held in the configuration/orientation described above, the interior hose 404 within the bulb 116 will extend from the second side of the bulb cap 402 downwards towards the bottom of the bulb 116. As shown, the interior hose 404 may extend down into the bulb fluid 514 that has collected at the bottom of the bulb 116 due to gravity.

As a result of the interior hose 404 extending into the bulb fluid 514, the user depressing or squeezing the bulb 116 with his/her hand or fingers may cause the bulb fluid 514 to enter the interior hose 404 and be transported towards the second valve 114. The bulb fluid 514 may pass through the second valve 118 and be delivered to the user via the fluid delivery hose 406 and mouthpiece 122/nozzle 124. Accordingly, when the amount of bulb fluid 514 within the bulb 116 becomes low, the interior hose 404 may still allow the user to have access to the water that is positioned towards the bottom of the bulb 116. Otherwise, without the interior hose 404, depression/squeezing of the bulb 116 by the user may result in the bulb fluid 514 not flowing through the second valve 118, remaining within the interior of the bulb 116, and not being delivered to the user. Moreover, without the interior hose 404, the user may need to depress/squeeze the bulb 116 with a relatively large amount of force in order to drink (or otherwise use) the bulb fluid 514.

Figure 6:
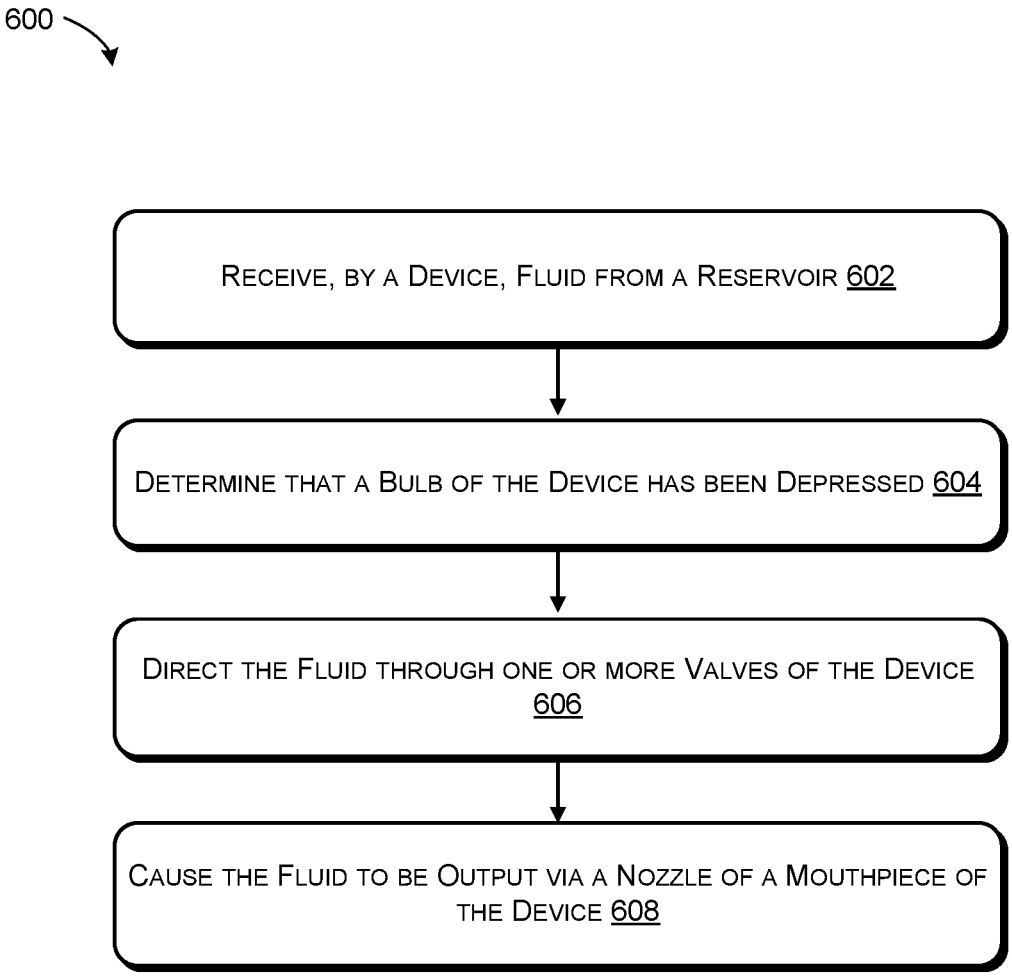
FIG. 6 illustrates a flow diagram that illustrates a process for delivering fluid to the user utilizing a hydration system and a device detachably coupled thereto.

FIG. 6 illustrates an example process for delivering fluid to a user of a hydration system. The example process is described in the context of the environment of FIGS. 1-5, but is not limited to those environments. The order in which the operations are described in each example process is not intended to be construed as a limitation, and any number of the described blocks can be combined in any order and/or in parallel to implement each process. Moreover, the operations illustrated in FIG. 6 may be performed by the device (e.g., device 104) illustrated in FIGS. 1-5.

Block 602 illustrates receiving, by a device, fluid from a reservoir. More particularly, the device 104 may be detachably coupled to a hydration system 102, such as a backpack-based hydration system, that includes a reservoir 106 and a reservoir hose 108. Provided that the device 104 detachably couples or connects to the hydration system 102, the device 104 may be considered an accessory device for the hydration system 102. In other embodiments, the device 104 may be permanently attached or affixed to the hydration system 102. Stored within the reservoir 106 of the hydration system 102 may be a fluid (e.g., a liquid, a gas, etc.), such as water, a sports drink, etc. The fluid may flow from the reservoir 106 and through the reservoir hose 108 to the device 104, which may be coupled to the reservoir hose 108 via the connector 110. The fluid may flow in a single direction from the reservoir 106 of the hydration system 102 to the device 104. The device 104 may also only allow the fluid to flow in a single direction within the device 104 based at least partly on one or more valves (e.g., the first valve 114 and/or the second valve 118), such as one or more check valves. In some embodiments, the reservoir hose 108 and a second hose that transports the fluid to the user (e.g., the fluid delivery hose 406) may be positioned/located on the same side of the bulb 116, or on the same side of a bulb cap 402 coupled to the bulb 116.

Block 604 illustrates determining that a bulb of the device has been depressed. In various embodiments, the device 104 may include a bulb 116 or pump that can be depressed, compressed, squeezed, etc., by the user operating the device 104. For example, when the user would like to consume (e.g., drink) or otherwise consume (e.g., spray the fluid on the user's body) the fluid, the user may apply an amount of pressure to the exterior surface of the bulb 116, such as by squeezing the bulb 116 of the device 104.

Block 606 illustrates directing the fluid through one or more valves of the device. In response to the user squeezing the bulb 116 of the device, the fluid contained within the bulb 116 may be directed through a valve (e.g., the second valve 118) and into the mouthpiece 122 of the device 104. Depression of the bulb 116 may cause the pressure within the interior of the bulb 116 to exceed the pressure on the other side of the second valve 118, which may cause the second valve 118 to allow the fluid to flow through the second valve 118. Fluid may also flow into the interior of the bulb 116 via a valve (e.g., the first valve 114). For example, when the pressure within the interior of the bulb 116 is less than the pressure on the other side of the first valve 114, the first valve 114 may allow the fluid to pass through the first valve 114 into the interior of the bulb 116. In other embodiments, the valve may allow the fluid to pass freely into the interior of the bulb 116, thereby allowing the fluid to fill and/or refill the bulb 116.

Block 608 illustrates causing the fluid to be output via a nozzle of a mouthpiece of the device. More particularly, and as stated above, based at least partly on the user squeezing the bulb 116, the fluid may pass through the second valve 118 into the mouthpiece 122. The mouthpiece 122 may include a chamber that stores the fluid before it is output through the nozzle 124 of the device 104. The fluid within the mouthpiece 122 may flow through the nozzle 124 for consumption (or other use) by the user. As a result, rather than having to apply suction to the mouthpiece 122/nozzle 124 to consume the fluid, the user may instead squeeze the bulb 116 of the device 104 in order to cause the fluid to be output.

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

The invention claimed is:

1. A backpack-based hydration system, comprising:

a reservoir that stores liquid;

a reservoir hose that transports the liquid from the reservoir to an accessory device that couples to the backpack-based hydration system, the accessory device comprising:

a connector that detachably couples the accessory device to the reservoir hose;

a bulb that is compressible by a user and that is to contain at least a portion of the liquid;

a bulb cap that contains a first check valve and a second check valve;

the first check valve controlling an extent to which the liquid flows into an opening of the bulb; and the second check valve controlling an extent to which the liquid exits the bulb through the opening of the bulb based on a first amount of pressure within an interior of the bulb, the first amount of pressure within the interior of the bulb being based on a second amount of pressure applied to an exterior surface of the bulb;

a mouthpiece that temporarily stores the liquid that exits the second opening of the bulb; and a nozzle that is in fluid communication with the mouthpiece and that controls at least one of a rate or a direction of the liquid as the liquid exits the accessory device.

2. The backpack-based hydration system as recited in claim 1, wherein the user consumes the liquid exiting the device without the user applying suction to the mouthpiece and the nozzle.

3. The backpack-based hydration system as recited in claim 1, wherein the second amount of pressure applied to the exterior surface of the bulb constitutes the user squeezing the bulb of the accessory device.

4. The backpack-based hydration system as recited in claim 1, wherein the first check valve causes the liquid to flow in a first direction into the bulb and the second check valve cause the liquid to flow in a second direction within the accessory device that is opposite of the first direction.

5. The backpack-based hydration system as recited in claim 1, wherein the first check valve allows the liquid to flow freely into the interior of the bulb to at least one of fill or refill the interior of the bulb.

6. The accessory device as recited in claim 1, wherein:

a first side of the first check valve is coupled to the opening of the bulb, the first check valve causing the liquid to flow through the opening of the bulb into the interior of the bulb based on a determination that the first amount of pressure within the interior of the bulb is less than a third amount of pressure that is associated with a second side of the first check valve; and a first side of the second check valve is coupled to the opening of the bulb, the second check valve causing the liquid to flow through the opening of the bulb into the mouthpiece based on a determination that the first amount of pressure within the interior of the bulb is greater than a fourth amount of pressure that is associated with a second side of the second check valve, wherein the first check valve and the second check valve are situated on a same side of the bulb.

7. The accessory device as recited in claim 1, further comprising:

a first stem that transports the liquid between the connector and the first check valve; and a second stem that transports the liquid between the second check valve and the mouthpiece.

8. A device comprising:

a pump that stores at least a portion of fluid that is initially stored in a reservoir of a hydration system, the fluid being transported to the device via a reservoir hose that is coupled to the reservoir;

a first check valve that causes the fluid to flow in a first direction into the device and that controls an extent to which the fluid flows into the pump;

a second check valve that causes the fluid to flow in a second direction out of the device and that controls an extent to which the fluid exits the pump, the first direction being opposite of the second direction; and a mouthpiece that temporarily stores the fluid that exits the pump and causes the fluid to exit the device without the user applying suction to the mouthpiece.

9. The device as recited in claim 8, wherein the first check valve allows the fluid to flow freely into an interior of the pump to at least one of fill or refill the interior of the pump.

10. The device as recited in claim 8, wherein the extent to which the fluid exits the pump is based at least partly on a first amount of pressure applied to an exterior surface of the pump.

11. The device as recited in claim 10, wherein a second amount of pressure within an interior of the pump is based at least partly on the first amount of pressure applied to the exterior surface of the pump.

12. The device as recited in claim 8, wherein:

a first side of the first check valve is coupled to an opening of the pump, the first check valve causing the fluid to flow through the first opening of the pump into an interior of the pump based on a determination that a first amount of pressure within the interior of the pump is less than a second amount of pressure that is associated with a second side of the first check valve; and a first side of the second check valve is coupled to the opening of the pump, the second check valve causing the fluid to flow through the opening of the pump based on a determination that the first amount of pressure within the interior of the bulb is greater than a third amount of pressure that is associated with a second side of the second check valve.

13. The device as recited in claim 8, further comprising a nozzle that is in fluid communication with the mouthpiece and that controls at least one of a rate or a direction of the fluid as the fluid exits the device.

14. A device comprising:

a pump that is compressible by a user;

a first check value that is coupled to an opening of the pump and that controls an extent to which fluid flows into an interior of the pump, the first check valve causing the fluid to flow in a first direction into the device;

a second check valve that is coupled to the opening of the pump and that controls an extent to which fluid exits the pump based at least partly on a first amount of pressure applied to an exterior surface of the pump, the second check valve causing the fluid to flow in a second direction into the device, the first direction being opposite of the second direction; and a mouthpiece that temporarily stores the fluid and that causes the fluid to exit the device without the user applying suction to the mouthpiece.

15. The device as recited in claim 14, further comprising a connector or a stem that couples the device to a reservoir hose of a backpack-based hydration system, the reservoir hose to transport the fluid from a reservoir of the backpack-based hydration system to the device.

16. The device as recited in claim 14, wherein:

the first check valve allows the fluid to flow freely into the interior of the pump to at least fill or refill the interior of the pump; or the extent to which the fluid flows into the interior of the pump is based at least partly on the first amount of pressure applied to the exterior surface of the pump.

17. The device as recited in claim 16, wherein the extent to which the fluid flows into the interior of the pump and the extent to which the fluid exits the pump is based at least partly on a second amount of pressure within the interior of the pump.

18. The device as recited in claim 17, wherein:

a first side of the second check valve is coupled to an opening of the pump, the second check valve causing the fluid to flow through the opening of the pump into the mouthpiece based on a determination that the second amount of pressure within the interior of the pump is greater than a third amount of pressure that is associated with a second side of the second check valve; and a first side of the first check valve is coupled to the opening of the pump, the first check valve causing the fluid to flow through the opening of the pump into the interior of the pump based on a determination that the second amount of pressure within the interior of the pump is less than a fourth amount of pressure that is associated with a second side of the first check valve.

19. The device as recited in claim 14, further comprising a nozzle that is in fluid communication with the mouthpiece and that controls at least one of a rate or a direction of the fluid as the fluid exits the device.

20. The device as recited in claim 13, wherein pressure applied to an exterior surface of the pump causes the fluid to flow out of the nozzle.

* * * * *